US005540370A

United States Patent [19]

Ring

[11] Patent Number: 5,540,370

[45] Date of Patent: Jul. 30, 1996

[54] OFFSET JOB SEPARATOR

[75] Inventor: Robert S. Ring, Rochester, N.H.

[73] Assignee: Moore Business Forms, Inc., Grand Island, N.Y.

[21] Appl. No.: 255,955

[22] Filed: Jun. 7, 1994

[51] Int. Cl.[6] ..... B26F 3/02

[52] U.S. Cl. ..... 225/100; 271/250; 271/253; 271/270

[58] Field of Search ..... 271/250, 251, 271/252, 253, 254, 270, 272, 273, 240; 225/4, 100

[56] References Cited

U.S. PATENT DOCUMENTS

| | | | |
|---|---|---|---|
| 2,190,418 | 2/1940 | Davidson et al. | 271/251 |
| 2,819,078 | 1/1958 | Durand . | |
| 4,014,539 | 3/1977 | Goodwin . | |
| 4,426,073 | 1/1984 | Mizuma . | |
| 4,438,918 | 3/1984 | Ito et al. . | |
| 4,669,719 | 6/1987 | Fratangelo . | |
| 4,805,890 | 2/1989 | Martin . | |
| 4,955,965 | 9/1990 | Mandel . | |
| 4,983,990 | 1/1991 | Frohlich . | |
| 5,004,220 | 4/1991 | Dreschel et al. | 271/251 X |
| 5,114,137 | 5/1992 | Olson . | |
| 5,162,857 | 11/1992 | Higeta et al. . | |
| 5,238,164 | 8/1993 | Freeman . | |
| 5,265,731 | 11/1993 | Van de Ven . | |
| 5,280,901 | 1/1994 | Smith et al. | 271/250 X |
| 5,342,040 | 8/1994 | Markgraf | 271/251 |

*Primary Examiner*—Rinaldi I. Rada
*Attorney, Agent, or Firm*—Nixon & Vanderhye

[57] ABSTRACT

The production of offset stacks of business forms is effected in a continuous (i.e. without interruption) manner until a vertical stacker into which the forms are fed is full. Between a detacher and the stacker, the forms are automatically and continuously directed either to the left or the right from a common center line to offset the forms into different groups with at least one form in each group. This offsetting action may be accomplished by a pair of angled conveyor belts with steel balls movable into and out of association with the conveyor belts by solenoids, and/or by two sets of diverter wheels which are also angled and which are moved up out of engagement with the forms or down into engagement with them. Edge guide rods are provided which are part of transport aligning mechanisms that are movable toward and away from each other to accommodate different form widths. Sensors are provided for sensing the first and/or last form in each group, and operate through a controller to switch the offsetting action.

28 Claims, 9 Drawing Sheets

Fig. 3
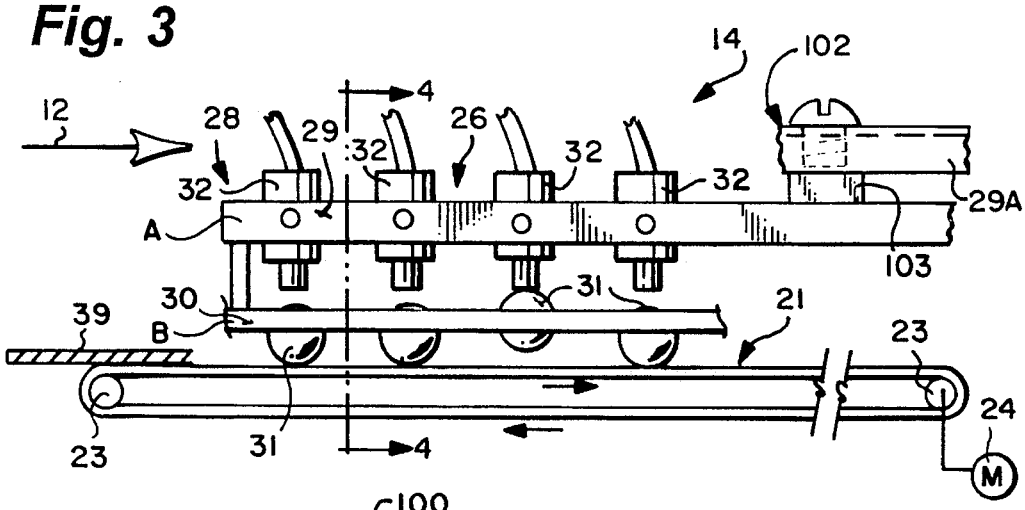
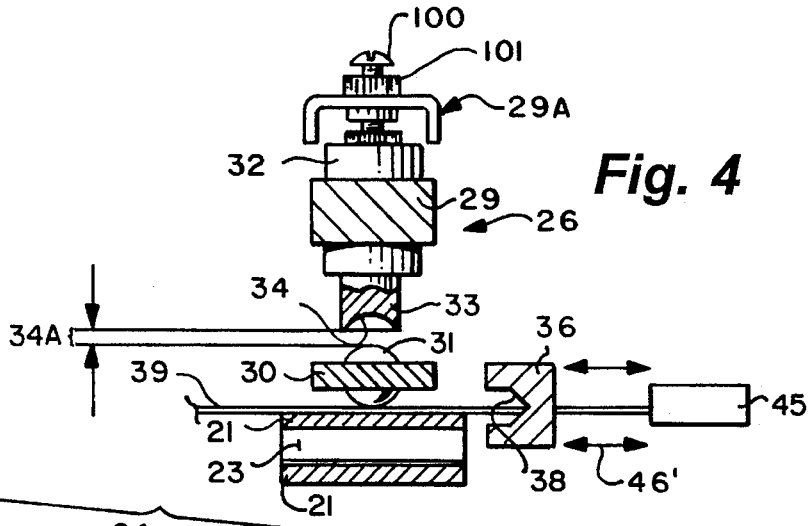
Fig. 4
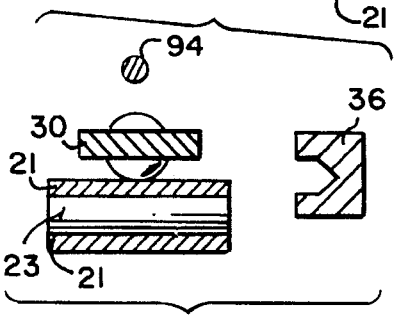
Fig. 15
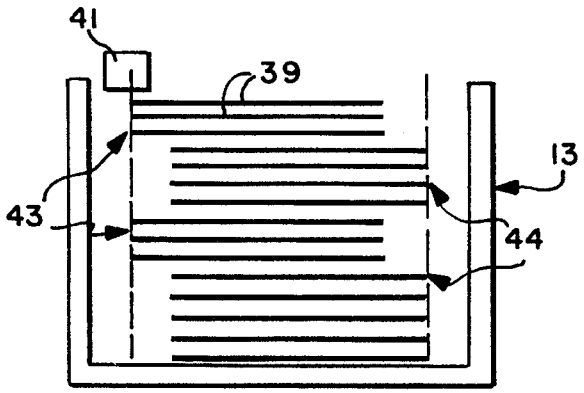
Fig. 5

OFFSET JOB SEPARATOR

BACKGROUND AND SUMMARY OF THE INVENTION

When continuous business forms are detached, it is highly desirable to provide some sort of a break between different groups of forms so that the detached forms may be handled separately in subsequent operations, such as mailing, printing, or the like. One simple, but effective, way to accomplish separation of the forms for ready handling in subsequent operations is to offset the forms into groups of forms. This is accomplished in a simple and effective manner in U.S. Pat. No. 5,238,164. However, while the offset stacking of forms in the U.S. Pat. No. 5,238,164 patent is highly successful, it is necessary to temporarily arrest the forms processing each time that a change-over from one offset orientation to another is accomplished. This slows down the processing speed, and the slow down can be significant if there are only a few forms in each group.

According to the present invention, a method and apparatus are provided for offsetting stacks of individual business forms in a continuous manner (that is, without interruption), at least until a stacker (if utilized) associated with the operation is full (rather than between each individual grouping of forms). Thus, the method and apparatus according to the present invention provide for higher volume production than discontinuous techniques, and also provide for varying form sizes. Also the equipment utilized according to the present invention is relatively simple so that it is relatively inexpensive and easy to construct and operate.

According to one aspect of the present invention, a method of producing offset stacks of individual business forms in a stacker from a detaching mechanism is practiced. The method comprises the following steps: (a) Automatically continuously detaching continuous business forms in the detaching mechanism to produce individual forms. (b) Automatically continuously feeding the detached individual forms from the detaching mechanism toward the stacker in a first direction. (c) Continuously acting on the individual forms as they are being continuously fed in the first direction to automatically move the forms in a second direction, substantially perpendicular to the first direction, to offset the individual forms into different groups with at least one form in each group. And (d) continuously automatically feeding the individual groups of forms into the stacker to provide stacks, each stack offset from the different stacks before and after it.

The stacker may be a vertical stacker, and step (d) may be practiced until the stacker is full, having a plurality of different stacks therein, and then steps (a) through (d) are interrupted until the stacker is emptied.

Step (c) may be practiced using first and second sets of a plurality of upper forms-engaging elements mounted above and in association with first and second lower forms conveyance structures, respectively. Step (c) is then practiced by sensing the position of the last form in each group and automatically moving the upper forms engaging sets of elements so that the upper elements are removed from operative association with the first of the lower forms conveyance structures and into operative association with the second lower conveyance structures, or vice versa. In one embodiment according to the invention, the upper forms-engaging elements each comprise a plurality of steel balls each mounted adjacent a solenoid, in which case step (c) is practiced by controlling the solenoids to lift the balls of the first upper elements in sequence. The corresponding balls of the second upper elements are dropped in sequence, or vice versa.

According to another aspect of the present invention, apparatus for producing offset stacks of individual business forms is provided comprising the following elements: (a) A detaching mechanism for automatically detaching continuous business forms to produce individual forms. (b) Means for automatically continuously feeding the detached individual forms from the detaching mechanism in a first direction. (c) Means for continuously acting on the individual forms as they are being continuously fed in the first direction to automatically move the forms in a second direction, substantially perpendicular to the first direction, to offset the individual forms into different groups with at least one form in each group. And (d) a stacker for receiving the individual groups of forms in different stacks, each stack offset from the different stacks before and after it.

The stacker may comprise a vertical stacker for containing a plurality of vertical stacks of forms, and the apparatus may further include a sensor for sensing when the stacker is full, and a controller for controlling operation of the apparatus to arrest operation until the stacker is emptied.

The means (c) may comprise first and second sets of a plurality of upper forms-engaging elements mounted above and in association with first and second lower forms conveying structures, respectively; and a plurality of sensors for sensing the position of the last form in each group and automatically moving the upper forms-engaging sets of elements so that the upper elements are removed from operative association with the first of the lower conveying structures and into operative association with the second lower conveying elements, or vice versa. The upper forms engaging elements may each comprise a plurality of steel balls each mounted adjacent a solenoid. The means (c) may then further comprise a controller for controlling solenoids to lift the balls of the first upper elements in sequence when corresponding balls of the second upper elements are dropped in sequence, or vice versa.

According to another aspect of the present invention, apparatus for handling substantially planar elements (such as paper sheets, business forms and the like) to produce offset stacks of substantially planar elements is provided. The apparatus comprises the following elements: A first set of powered bottom conveying structures for conveying substantially planar elements in a first generally horizontal direction. A second set of powered bottom conveying structures for conveying substantially planar elements in a second generally horizontal direction, and positioned with respect to the first direction so that there is an angle of about 2 degrees between the first and second directions. A first set of upper planar element engaging structures for selectively cooperating with the first set of bottom conveying structures and mounted above the first set of bottom conveying structures for selective movement into and out of operative association with the first set of bottom conveying structures. A second set of upper planar element engaging structures for selectively cooperating with the second set of bottom conveying structures and mounted above the second set of bottom conveying structures and mounted above the second set of bottom conveying structures for selective movement into and out of operative association with the second set of bottom conveying structures. A powered mechanism for automatically moving the first set of engaging structures downwardly into operative association with the first set of bottom conveying structures while the second set of engaging structures is moved upwardly out of operative association with the second set of bottom conveying structures, and vice versa.

The first and second sets of bottom conveying structures may comprise first and second angled endless conveyor belts. The first and second sets of upper engaging structures may comprise first and second linear frames each mounting a plurality of rounded surface magnetic material element (e.g. steel balls). The powered mechanism may comprise a solenoid in association with each of the steel balls and when energized lifting the steel ball associated therewith out of operative engagement with a planar element on a bottom conveyance structure, and when deenergized allowing the ball associated therewith to fall into operative engagement with a planar element on a bottom conveyance structure. The solenoid may include a ball engaging element that is contoured to substantially conform to the rounded surface of the ball.

The apparatus preferably further comprises first and second side rails mounted adjacent the first arid second bottom conveying structures for engaging side edges of substantially planar elements as they are conveyed in the first or second direction, the bottom conveying structures being disposed between the first and second side rails. Each of the side rails may be contoured to allow precise engagement of a substantially planar element edge therewith. Also, powered means may be provided for moving the first or second rails toward or away from each other to accommodate substantially planar elements of different widths.

Alternatively, or additionally, the first and second sets of upper engaging structures may each comprise one or more upper diverter wheels and the bottom main structure that is associated with the upper diverter wheels may comprise conveyor belts or one or more lower diverter wheels. For example, the upper diverter wheels may be mounted in pairs, each pair mounted for rotation about a substantially horizontal axis, and a powered mechanism may comprise a motor (e.g. electric motor) for pivoting a shaft about the axis (parallel to the shaft). The pairs of diverter wheels may be connected so that the motor rotates a main shaft to pivot the first set of upper engaging structures in a first direction, the second set of upper engaging structures is automatically pivoted in a second direction opposite the first direction.

As indicated above, the substantially planar elements typically comprise business forms, in which case the apparatus typically is in combination with a continuous business form detaching mechanism located upstream of the conveyance structures in the first and second directions, and a stacker for individual business forms located downstream of the conveyance structures in the first and second directions. A guide assembly is also typically provided between the detaching mechanism and conveyance structures, and a shingling conveyor between the conveyance structures and the stacker.

Typically, a plurality of sensors are provided for sensing the positions of the planar elements as they move in the first or second directions. Control means are also provided for controlling the conveyance structures and powered mechanism in response to the sensors so as to provide continuous operation of the apparatus so that offset stacks of substantially planar elements are formed without interruption between stacks. The control means may comprise means for energizing the solenoids of the first engaging structures in sequence while de-energizing the corresponding solenoids of the second engaging structures in sequence, or vice versa, to provide a smooth and continuous transition from one offset configuration to another.

It is the primary object of the present invention to provide a method and apparatus for continuously producing offset stacks of individual business forms, or like substantially planar elements, in a simple yet effective manner. This and other objects of the invention will become clear from an inspection of the detailed description of the invention, and from the dependent claims.

BRIEF DESCRIPTION OF THE DRAWINGS

FIG. 3 is a side schematic view of a part of the offsetting mechanism of the apparatus of FIG. 1 with the nearest side rail removed for clarity of illustration;

FIG. 4 is a schematic cross-sectional view taken along lines 4—4 of FIG. 3 showing the relationships between the conveyor, solenoid controlled balls, and side rail during operation of the apparatus of FIG. 3;

FIG. 5 is a front schematic view of the vertical stacker of the apparatus of FIG. 1 shown essentially filled with offset stacks of forms;

FIG. 15 is a schematic view like that of FIG. 14 related to the FIG. 9 embodiment.

DETAILED DESCRIPTION OF THE DRAWINGS

Figure 1:
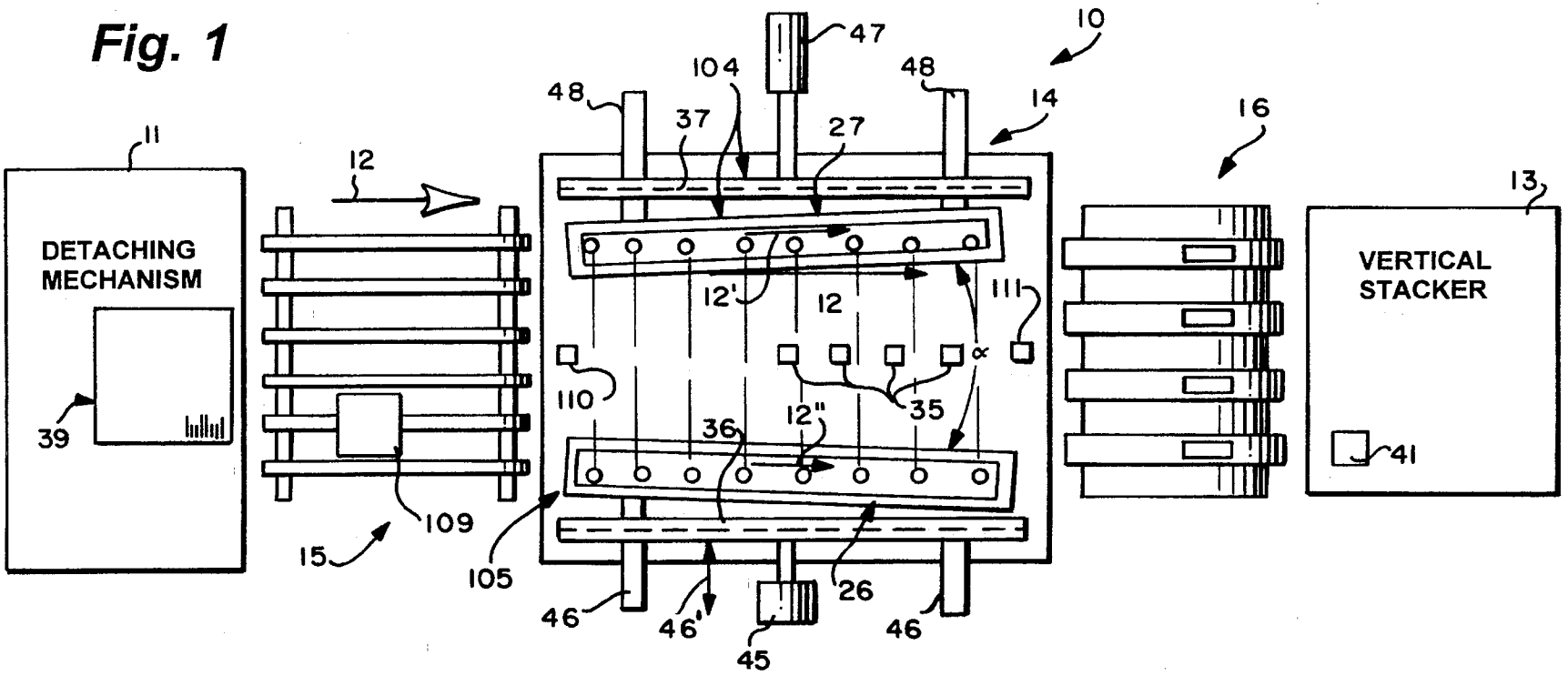
FIG. 1 is a top plan schematic view of a first embodiment of exemplary apparatus according to the present invention, for practicing an exemplary method according to the present invention.

Exemplary apparatus according to the present invention is illustrated generally at reference numeral 10 in FIG. 1. The apparatus includes a detaching mechanism, such as a conventional detacher 11 for detaching continuous business forms into individual forms, the forms after detachment being conveyed in the direction 12 (which is substantially horizontal) to a conventional vertical stacker 13. Between the components 11 and 13 is an offsetting mechanism 14, according to the invention. Between the detacher 11 and offsetting mechanism 14 there preferably is provided a conveying and guiding assembly 15, which is seen more clearly in FIG. 2, and between the offsetting mechanism 14 in the stacker 13 is a conventional singling conveyor 16.

Figure 2:
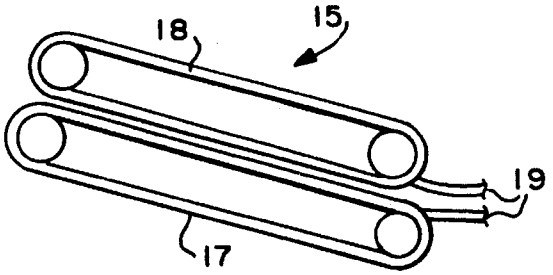
FIG. 2 is a schematic side view of the guide assembly between the detacher and offsetting mechanism of the apparatus in FIG. 1.

The conveying and guiding assembly 15, as seen in FIG. 2, may comprise a bottom powered conveyor, an endless conveyor belt assembly 17, and an upper endless conveyor belt assembly 18. Upper and lower guide plates 19 extend from belts 17, 18 to the offsetting mechanism 14 to ensure proper delivery of the business forms from the detacher 11.

The offsetting mechanism 14 illustrated in FIGS. 1, 3 and 4 preferably comprises first and second powered bottom conveying structures, preferably the angled conveyor belts 21 and 22. As seen in FIG. 3, with respect to the conveyor belt 21, it is mounted for movement around rollers 23, and one (either one) or both of the rollers 23 may be powered, by driving a pulley associated with a roller 23. Powering may be performed—as illustrated schematically in FIG. 3—by the electric motor 24, driving roller 23 about shaft 117 (see FIG. 6).

The belts 21, 22 are disposed with respect to each other so that they make an angle of about 4° between each other, this being illustrated by the angle α in FIG. 1, i.e. so that each makes an angle of about 2° with respect to direction 12. [Note that the angle is greatly exaggerated in FIG. 1 for clarity.]

When the forms are being conveyed by the first angled conveyor belt 21, they are conveyed in a first generally horizontal direction 12, after being side shifted in direction 12', and when conveyed by the second angled conveyor belt 22 are conveyed in the substantially horizontal direction 12 after being side shifted in direction 12". The directions 12', 12" are only slightly offset horizontally from the direction 12 (but parallel to it).

Typically forms which engage the top surface of the belts 21, 22 are light enough that they will not be positively conveyed by (certainly not at the same speed as) the conveyors 21, 22 unless there is some mechanism to apply a downward force to the forms to bring them into good frictional contact with the belts 21, 22. For this purpose the first and second sets of upper forms-engaging structures 26, 27 are provided. The structures 26, 27 are mounted above the angled belts 21, 22. While, as indicated in FIG. 1, it is desirable to have the structures 26, 27 have essentially the same "line" as the belts 21, 22 (that is, extending in the direction 12', 12", respectively), in a situation where the belts 21, 22 are wide enough, and the angle α small enough, the structures 26, 27 may be parallel to the direction 12 as long as the individual forms-engaging elements (to be later described) associated therewith are in contact with the belts 21, 22.

In the preferred embodiment of the structures 26, 27 illustrated in FIGS. 3 and 4, each of the structures 26, 27 comprises a substantially linear frame—shown generally by references numeral 28 in FIG. 3. The frame 28 preferably comprises upper portions 29 and 29A and a lower portion 30. Extending through openings formed in a lower portion 30 (see FIGS. 3 and 4) are a plurality (e.g. typically from 6–10, preferably 8) rounded surface magnetic material elements 31. The rounded surface of the elements 31 ensures that there is no excessive force applied to business forms or other substantially planar elements that the structures 31 engage so that the forms may be readily side shifted in the directions 12', 12". In the preferred embodiment illustrated in the drawings, the elements 31 are steel balls which are of such a size and mass that they are moved upwardly out of contact with belt 21 (or business form thereon) by a solenoid 32 associated therewith and mounted in the upper frame structure 29. Each of the solenoids include a ball engaging element (piston) 33 (FIG. 4), which may be contoured as indicated by the surface configuration 34, to substantially conform to the rounded surface of the ball 31 associated therewith.

In FIGS. 3 and 4 the solenoids 32 are illustrated deenergized. When a solenoid 32 is energized, it provides a powerful magnetic attracting force which quickly lifts the ball 31 into contact with the surface 34 thereof so that the ball 31 will no longer contact the business form passing therepast, yet will still be aligned with the opening (not shown) in the lower frame 30 so that when the solenoid 32 is deenergized the ball 31 quickly falls back down into operative association with the form on the belt 21.

Each of the solenoids 32 may be mounted in such a way so that position of the surface 34 thereof may be adjusted up or down with respect to the lower frame 30. This allows for simple yet effective set-up of the gap between the top of each ball 31 and the end of each ball engaging element (solenoid core) 33 in order to optimize the speed at which the ball 31 is attracted to the element 33 at the moment that the solenoid 32 is energized. This is accomplished via the core adjusting screw 100 that is threaded into a tapped hole in the top of the core 33. The adjusting screw is fixed in the adjusting rail 102 and locked in place with lock nut 101. The adjusting rail 102 is fixed to upper frame structure 29 and spaced apart from it by spacers 103.

In order to sense the position of business forms as they are conveyed generally in the direction 12—so as to know when to energize the solenoids 32 associated with one of the linear frames 28, while de-energizing the solenoids associated with the other frame 28 (or vice versa)—a plurality of sensors 35 preferably are provided. The sensors 35 may be mounted as illustrated schematically in FIG. 1 between the conveyors 21, 22. The sensors 35 may be any conventional sensors, such as optical sensors, and they are connected up to a controller, such as the controller 42 illustrated in FIG. 8.

The offsetting mechanism 14 also preferably comprises first and second side rails 36, 37 (see FIGS. 1 and 4) which are typically mounted adjacent the angled conveyors 21, 22 for engaging the side edges of the business forms or other substantially planar elements as they are conveyed in the directions 12, 12', 12". The conveyors 21, 22 are disposed between the side rails 36, 37 as illustrated in FIG. 1. The side rails 36, 37 preferably are contoured—as illustrated by the contoured surface 38 for the rail 36 in FIG. 4—so as to allow for precise engagement of the business form 39 edge therewith, as seen in FIG. 4.

The rails 36, 37 are each part of an overall assembly (104, 105) including angled conveyors 21, 22. Each assembly moves in direction 46 to adjust for forms 39 of different widths. These two assemblies 104, 105 are the transport aligning machines.

The transport aligning mechanisms 104, 105 also may be mounted so that they are movable in a generally horizontal direction which is essentially perpendicular to the direction 12 so as to accommodate forms 39 of different widths. For example, a powered mechanism 45 connected to the transport aligning mechanism 105 may move the transport aligning mechanism 105 in the direction 46', the transport aligning mechanism 105 being guided by smooth surfaced guide rods 46 (of round or polygonal cross section). A similar powered mechanism 47 for moving the transport aligning mechanism 104 along guide rods 48 also is provided. The powered mechanisms 45, 47 may be any suitable conventional structure, such as a hydraulic or pneumatic cylinder, rotating screw associated with a linear nut, or the like, the details of the mechanisms for moving, the transport aligning mechanisms 104, 105 toward and away from each other in the direction 46' not being part of the invention.

The vertical stacker 13—which is downstream of the conventional shingling conveyor 16—may be of any suitable conventional construction, and has a sensor 41 associated therewith for sensing when the stacker 13 is full. FIG. 5 illustrates the stacker 13 when full with a plurality of groups of business forms 39, each group being offset from the previous group. For example, the groups 43, which have been powered in the direction 12", are offset with respect to the groups 44, which have been powered in the direction 12', so that they may be readily separated from each other. While the number of forms 39 in each of the groups 43, 44 is illustrated as varied in FIG. 5, the same number of forms 39 (from one to all the volume of the stacker 13) in each of the groups 43, 44 may be provided.

Figure 6:
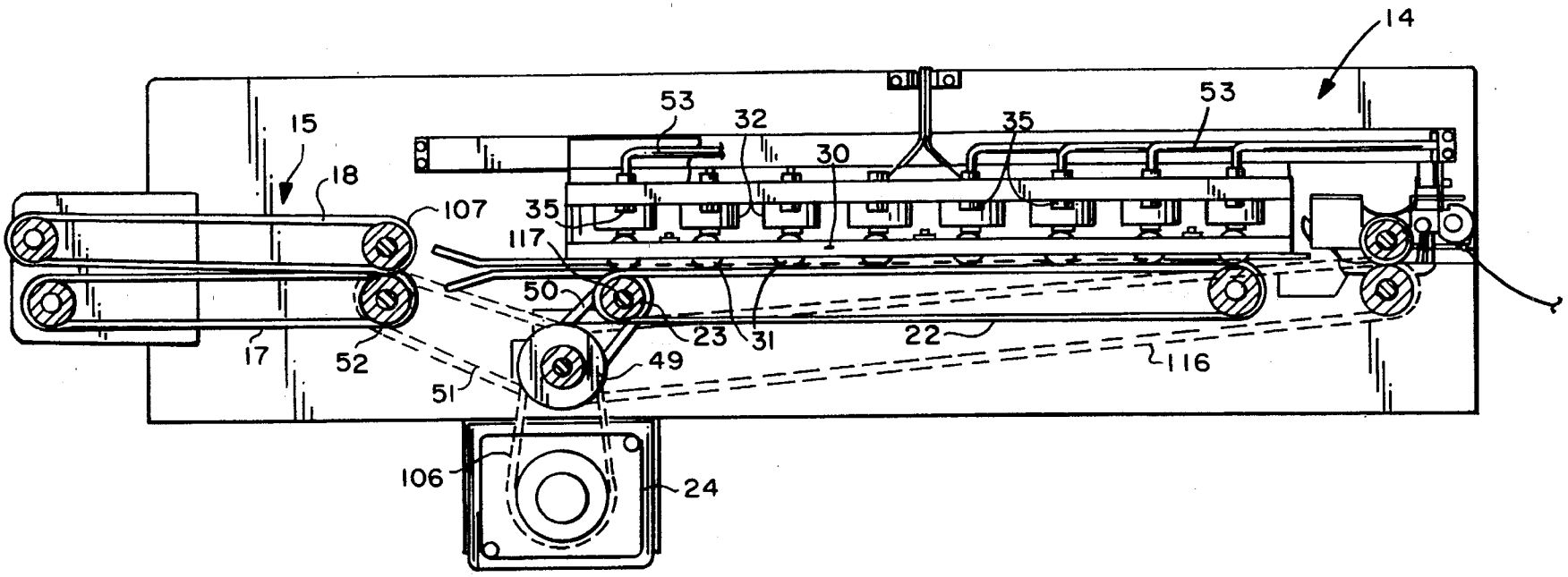
FIG. 6 is a more detailed side view of the guiding assembly and offsetting structure of the apparatus of FIGS. 1 through 4, with minor changes in the relative orientation and details of component parts.
Figure 7:
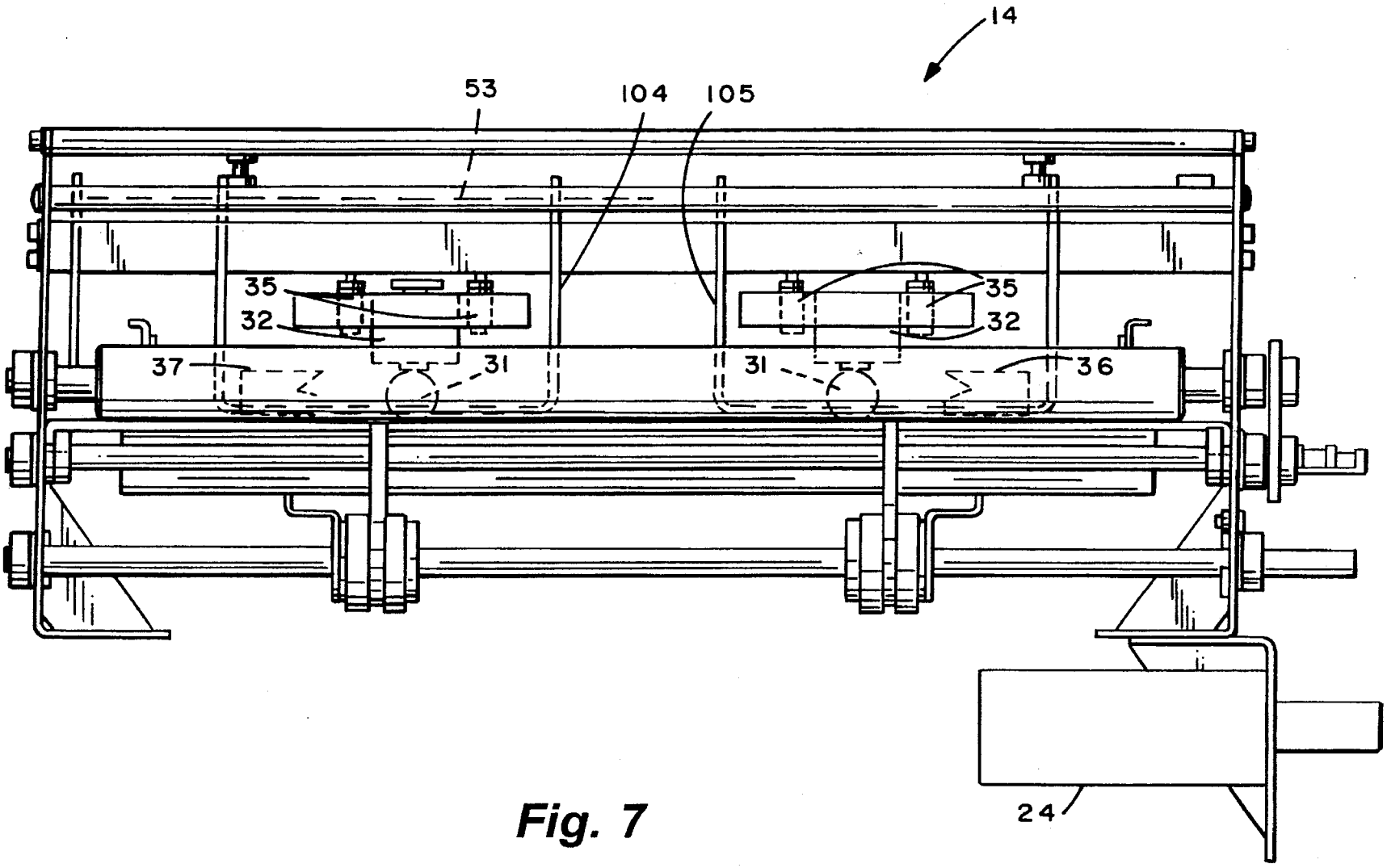
FIG. 7 is a front view of the apparatus of FIG. 6.

FIGS. 6 and 7 illustrate in a less schematic manner an exemplary construction of the conveying and guiding mechanism 15 (FIG. 6), and the offsetting mechanism 14 (FIGS. 6 and 7). As illustrated in FIG. 6, a motor 24 may be mounted between the mechanisms 14, 15 so as to power both the conveyor belt 17 and the conveyor belts 21 and 22.

A common motor 24 drives a pulley 49 through belt 106, pulley 49 in turn being connected to belt 116 which drives downstream components. Belt 51 from pulley 49 drives shaft 52. Shaft 52 drives belt 17 and through a gear set 107 belts 18 are powered.

The common pulley 49 also powers roller 23 through belt 50. Roller 23 powers belt 22. A common conduit 53 is provided, protecting electrical leads extending to each of the sensors 35, as seen in FIG. 6.

Figure 8:
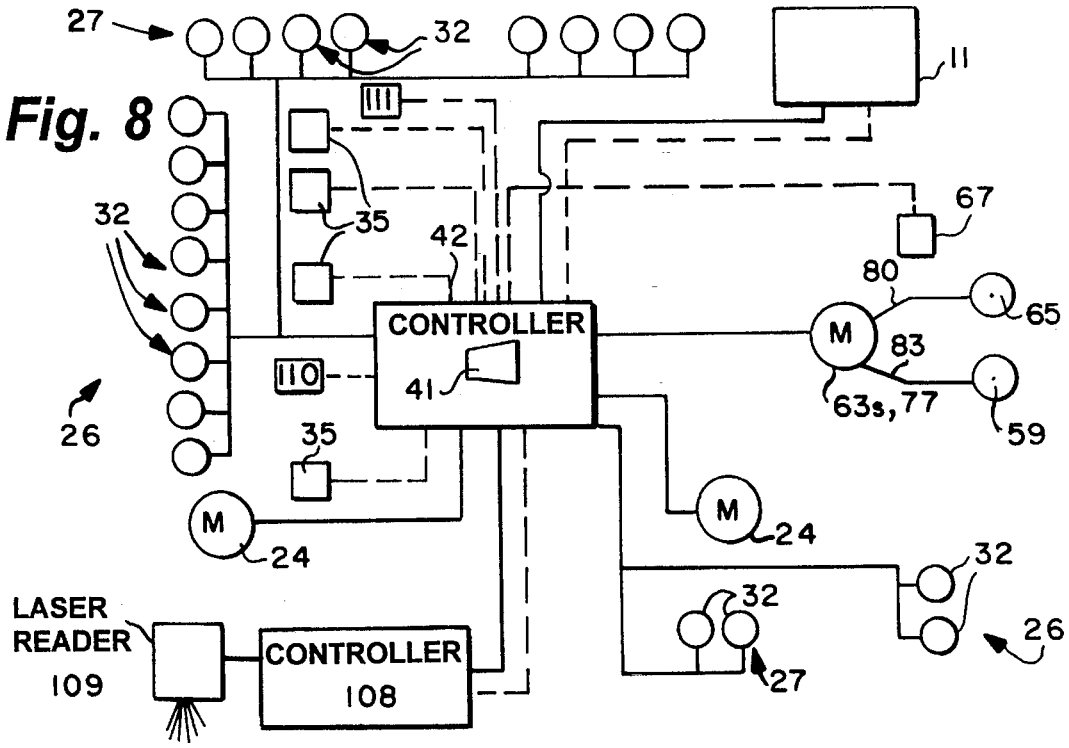
FIG. 8 is a control schematic showing an exemplary interconnection between the components of the apparatus of FIGS. 1 through 7 on the left-hand side thereof and a control schematic of the apparatus of FIGS. 9 through 14 on the right-hand side thereof.

FIG. 8 illustrates, on the left-hand side thereof, a control schematic indicating the interconnections between the operative components of the apparatus of FIGS. 1 through 7. The sensors 35, 110, 111 provide input to the controller 42—such as a conventional computer controller—as does the stacker sensor 41, the controller 108, and the machine 11. The solenoids 32, the motor 24, and the machine 11 are controlled by the controller 42. With particular reference to FIGS. 1 through 5 and 8, an exemplary manner of operation of the apparatus 10 will now be described:

OPERATION OF FIG. 1 EMBODIMENT

The guide rails 36 (near side) and 37 (far side) are positioned so that they are spaced apart in the direction 46' a distance equal to the width of a form 39 to be handled thereby, plus the offset distance to be provided between stacks 43, 44 (typically about 0.5–2 inches, this distance being seen schematically in FIG. 5 as the distance between the left or right side edges of the forms of the group 43 with respect to the forms of the group 44). Typically, the spacing is such that all of the balls 31 of each of the frames 26, 27 engage the form 39 if all the balls 31 are lowered.

As the leading edge of the first form passes under the "infeed" sensor 110 (the first sensor in the direction 12 as seen in FIGS. 1 or 6), the apparatus 10 is enabled. Enabling is effected by controller 42 energizing all solenoids 32 associated with the mechanism 27 causing all the balls 31 associated with the structure 27 to be lifted off the angled belt 22. The solenoids 32 associated with the mechanism 26 are not energized, meaning that the balls 31 ride on the belt 21. As the forms 39 are conveyed in the direction 12, since the balls 31 associated with the mechanism 26 and belt 21 are on the belt 21, the forms 39 will be moved in the direction 12" so that the near side edges thereof are in contact with the surface 38 of the first rail 36. The forms 39 then pass through the shingling conveyor 16 into the vertical stacker 13 providing the bottom-most form group 44 (see FIG. 5).

As the leading edge of the last form in the group 44 passes under the first sensor 110, the controller 42 energizes the first solenoid 32 in the direction 12 associated with the mechanism 26, while at the same time de-energizing the first solenoid 32 in the direction 12 of the mechanism 27, allowing the ball 31 associated therewith to drop onto the belt. This sequence continues for the other sensors 35 in the direction 12 (each sensor 35 providing a signal to the controller 42 so that one or more solenoids 32, in sequence, associated with the mechanism 26 are energized while the corresponding solenoids 32 associated with the mechanism 27 are deenergized). Typically a number of sensors 35 will be provided so that each of the second, third and fourth solenoids 32 for each of the mechanisms 26, 27 are energized or deenergized, respectively, in sequence. Then, when the trailing edge of the last form 39 in the group 44 passes under the first sensor 35 in the direction 12 the solenoid 32 over the 5th ball 31 of the mechanism 26 is energized while the solenoid 32 over the 5th ball 31 of the mechanism 27 is deenergized, and the sequence continues for the other sensors 35 until all of the balls 31 associated with the mechanism 26 are lifted out of contact with the belt 21, and all the balls associated with The mechanism 27 have dropped into contact with the belt 22 (or a form 39 thereon). Thus, the first form 39 of the next group 43 of forms that is to be provided is moved in the direction 12' so that the side edge thereof engages the rail 37.

The operation as described above continues, without interruption of any of the conveyance of the forms 39 generally in the direction 12, until the sensor 41 associated with the stacker 13 indicates that the stacker 13 is filled. At that time, the sensor 41 sends a signal to the controller 42 to stop the operation of the motor 24 and preferably, at the same time, raising up all of the balls 31 by energizing all of the cylinders 32 associated with both mechanisms 26, 27, until the stacker 13 has been emptied. Then a new sequence is initiated. Thus, in this way, a plurality of groups of forms 43, 44 are provided in stacks before there is any interruption in the operation of the apparatus 10, providing quick yet efficient operation and grouping of forms.

While the above operating sequence is preferred, of course other operating sequences may also be implemented. For example, three different offset configurations of forms may be provided by adding a third sequence between the sequences (described above) when all of the solenoids 32 associated with one of the mechanisms 26, 27 are energized, while the others are deenergized, whereby all of the solenoids 32 associated with both the mechanisms 26, 27 are deenergized. Since the speeds of the conveyors 21, 22 are the same (being commonly driven by motor 24) there will be counter-vailing forces applied to a business form 39, and as long as the business form 39 has sufficient tensile strength a grouping will be formed of forms 39 which are conveyed exactly in the direction 12, between the extremes of offset illustrated for the groups 43, 44 in FIG. 5.

Figure 9:
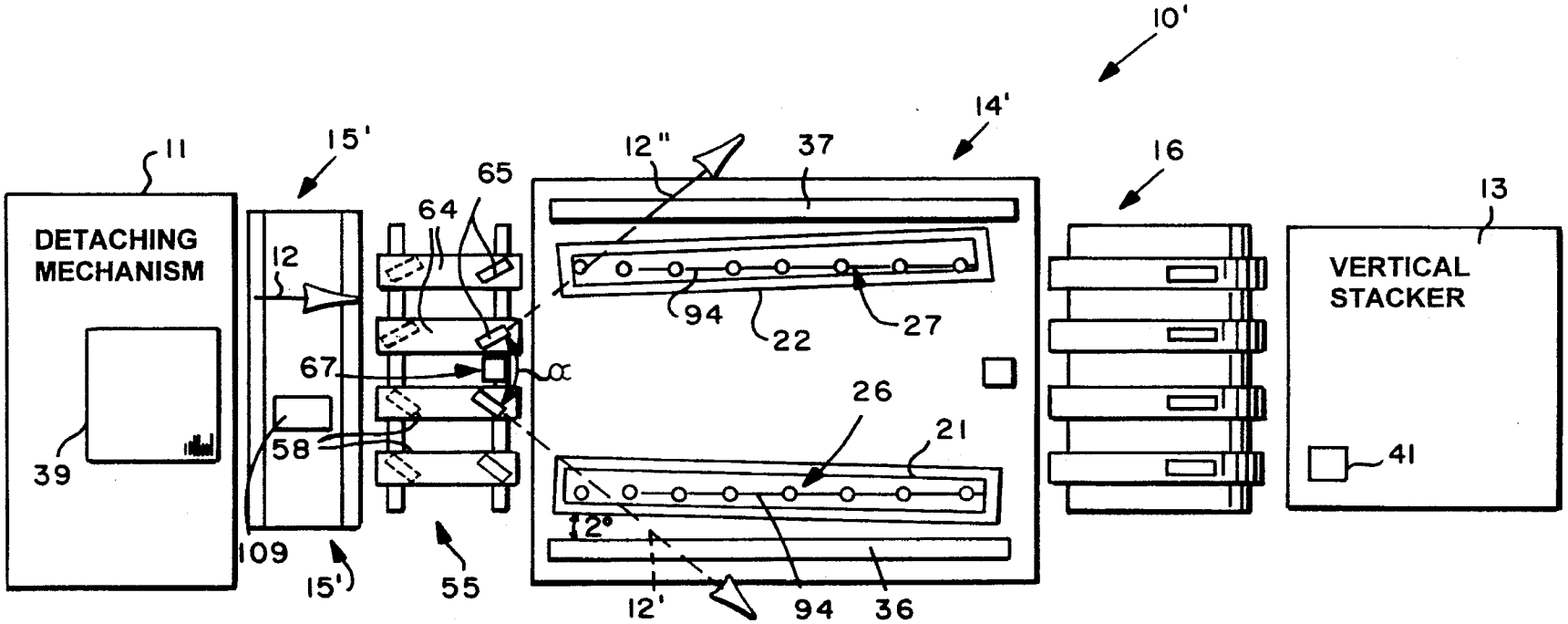
FIG. 9 is a view like that of FIG. 1 for another exemplary embodiment of the apparatus according to the present invention.

According to the invention one could also incorporate a laser bar code reader 109 (see FIGS. 1, 8 and 9). The reader 109 would allow random job separation by detecting the last page of any job set (or the first page, depending on the logic used). The laser reader 109 would send a signal to a processor [M9000] to initiate an offsetting sequence after enabling has already taken place by virtue of the leading edge of the first form 39 passing under the infeed sensor 10.

FIGS. 9 through 14 (and the right-hand side of FIG. 8) illustrate another exemplary embodiment of the apparatus according to the present invention. This apparatus—shown generally by reference numeral 10', as seen in FIG. 9—includes the same conventional detacher 11, shingling conveyor 16, and vertical stacker 13 as the FIG. 1 embodiment. Differences between the apparatus 10' and the apparatus 10 include the guiding mechanism 15' typically being slightly different than mechanism 15 (e.g. 15' having no belts), and the mechanism 14' being the same or slightly different than the mechanism 14 (e.g. 14' utilizing only two sensors but otherwise being identical to 14). However, the main difference is the provision of a diverter wheel assembly 55 between the guiding mechanism 15' and the mechanism 14'.

The diverter wheel assembly 55 provides the main mechanism for moving the forms 39 in either the directions 12' or 12". While preferably the mechanisms 26, 27 associated with angled conveyor belts 21, 22 are still provided in the mechanism 14', less sensors are necessary and the control sequence for the mechanism 26, 27 solenoids 32 is much simplified. Alternatively, the mechanisms 26, 27 and associated angle belts 21, 22 may be replaced by a single straight conveyor belt if the necessary offsetting action can be provided completely by the diverter wheel mechanism 55.

Figure 10:
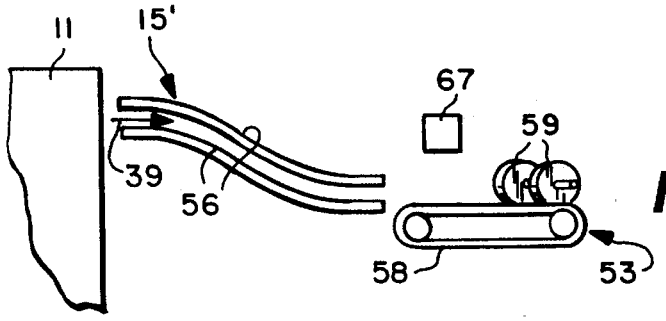
FIG. 10 is a side schematic view of the detaching mechanism, guide assembly and diverter wheel mechanism of the apparatus of FIG. 9.
Figure 11:
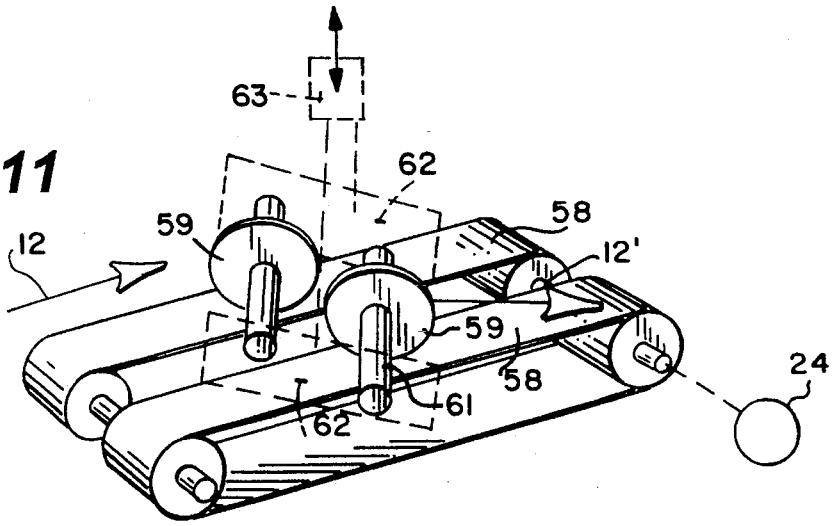
FIG. 11 is a top schematic perspective of one set of diverter wheels of the diverter wheel mechanism of FIGS. 9 and 10 with a powered mechanism for lifting or lowering thereof shown schematically in dotted line.

As seen schematically in FIG. 10, the guide mechanism 15' may simply comprise upper and lower contoured plates 56, the forms 39 being powered between the plates 36 simply by the conveying action of the detaching mechanism (e.g. burster or cutter) 11. The diverter mechanism 55 of the embodiment of FIGS. 9 through 11 comprise first conveyor belts 58 for receiving forms 39 from the guide mechanism 15' associated with the first set (one or more, preferably two) of diverter wheels 59. As schematically illustrated in FIG. 11, the first set of diverter wheels 59, associated with the conveyor belts 58 rotate about shafts 61 which are connected to the mounting mechanism 62. The mechanism 62 is in turn connected to the powered mechanism 63 which simultaneously moves the diverter wheels 59 upwardly out of operative association with the belts 58, or lowers them in operative association with the belts 58. A similar arrangement is provided for the second set of diverter wheels 65, associated with belts 64.

A single sensor 67 is all that is needed in association with the apparatus 10' (instead of the plurality of sensors 35, 110 and 111 in the FIG. 1 embodiment), the sensor 67 typically being just upstream (in the direction 12) of the diverter wheels 59, 65.

Figure 12:
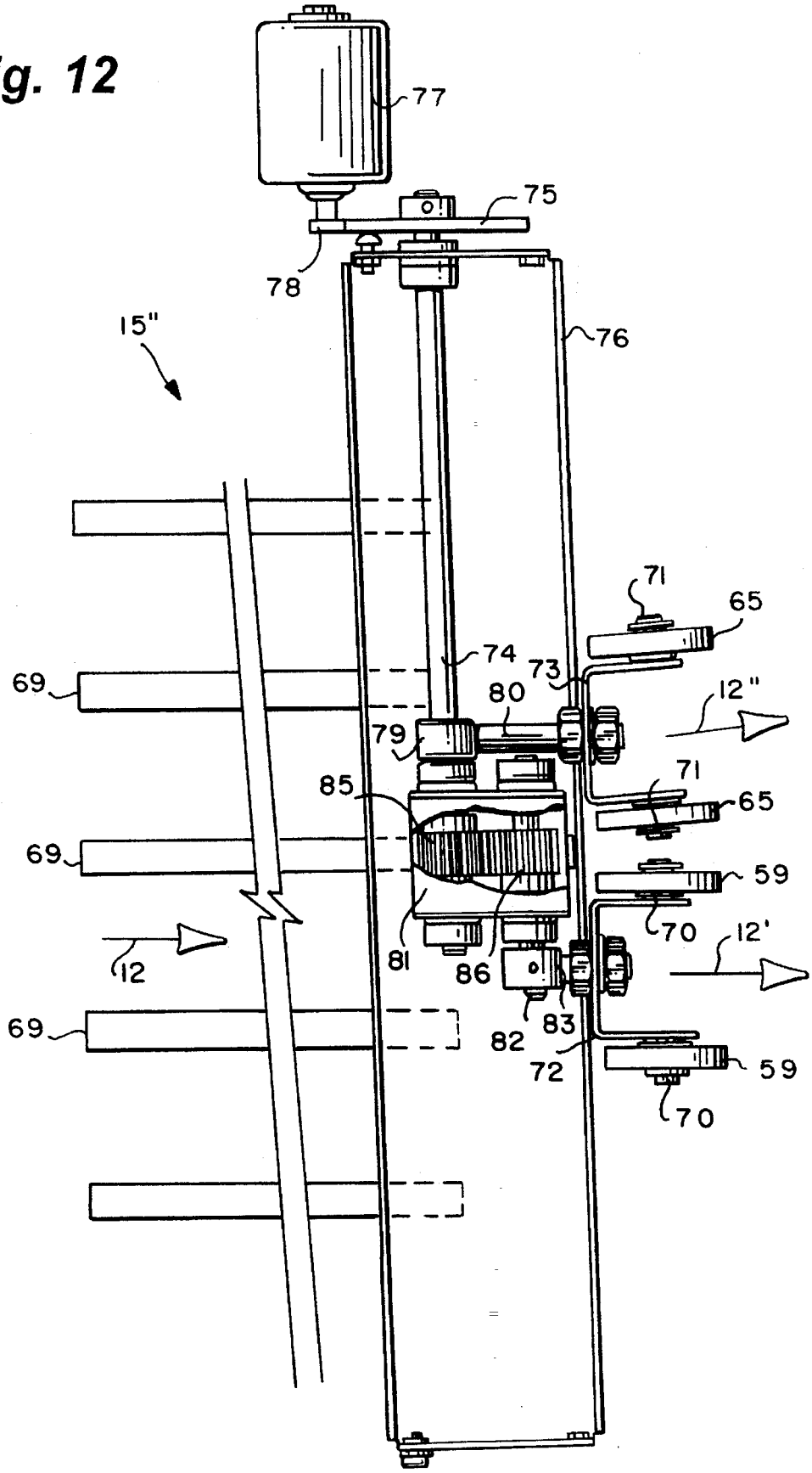
FIG. 12 is a top plan view of an alternative configuration of guide assembly and diverter wheels, including the mechanism for lifting and lowering thereof, that may be used with the apparatus of FIG. 9.
Figure 13:
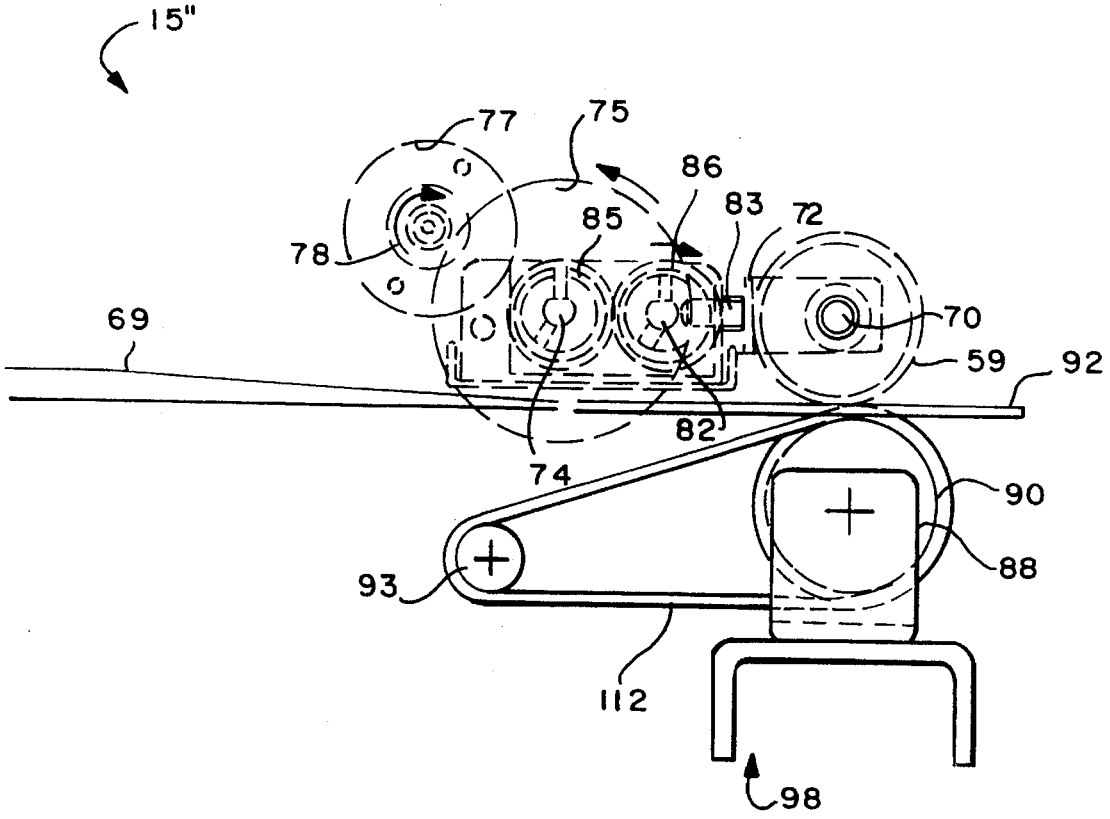
FIG. 13 is a side view of the apparatus of FIG. 12.
Figure 14:
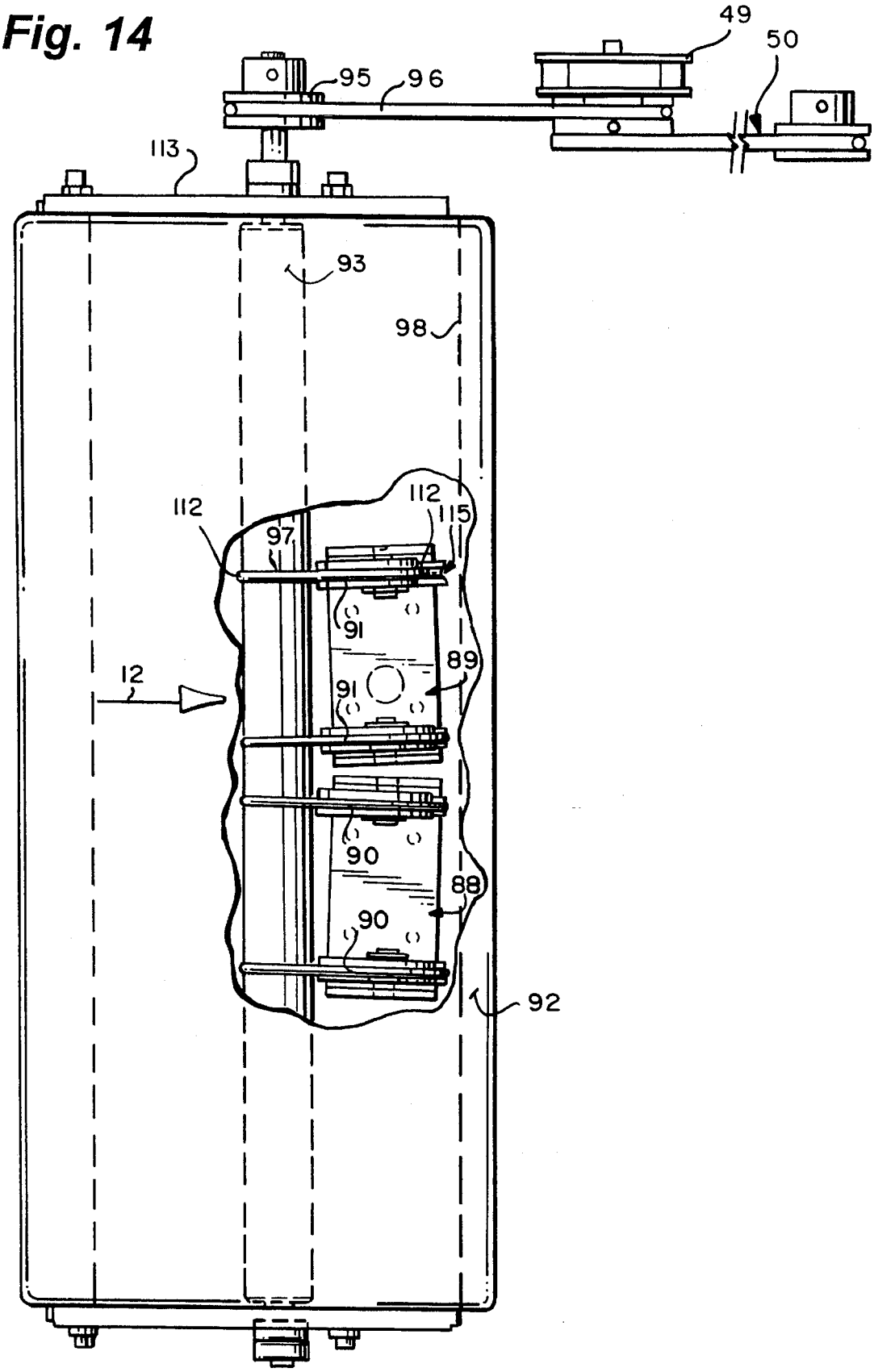
FIG. 14 is a top plan view of the lower components associated with the diverter wheel mechanisms of FIG. 12.

FIGS. 12, 13 and 14 provide another illustration of an exemplary raising and lowering mechanism for diverter wheels 59, 65, and another exemplary guiding mechanism 15". The guiding mechanism 15" merely comprises a plurality of flexible (e.g. Mylar) strips 69 which are generally parallel to the direction 12 and which are provided on a substantially flat surface (not numbered) to hold the forms 39 in contact with the flat surface.

The apparatus for providing lifting or lowering of the diverter wheels 59, 65—as illustrated in both FIGS. 12 and 13—may comprise pins 70 associated with the wheels 59 and extending perpendicular to the direction 12', and pins 71 associated with the wheels 65 and extending perpendicular to the direction 12". The pins 70 are mounted to a U-shaped bracket 72 while the pins 71 are mounted to a U-shaped bracket 73. A common shaft 74 is provided for essentially providing pivotal action of the brackets 72, 73 about a generally horizonal axis essentially perpendicular to the direction 12' to the shaft 74 being rotated by a gear 75, and mounted in a frame 76. An electric motor 77 has a drive gear 78 thereof in engagement with the gear 75 attached to the shaft 74, and preferably the motor 77 is reversible.

The bracket 73 is mounted by a collar 79 and an arm 80 to the shaft 74, and the shaft 74 also extends into the gear housing 81 which includes the shaft 82 parallel to the shaft 74 and connected to the bracket 72 by the arm 83. A gear 85 (see FIGS. 12 and 13) in the housing 81 is connected to the shaft 74, while a gear 86 in the housing 81 is connected to the shaft 82. The gearing arrangement is such that when the gear 78 is rotated clockwise (looking into the motor 77 past the gear 78), the shaft 74 is rotated counterclockwise, causing the arm 80 to lift the diverter wheel 65 up, out of engagement with forms 39, while simultaneously the gears 85, 86 cause rotation of diverter wheels 59 downwardly into engagement with the forms. Operation of the motor 77 is terminated after only a few degrees of rotation. When the gear 78 is rotated counterclockwise, the opposite result occurs, namely the diverter wheels 59 are rotated (pivoted) upwardly out of engagement with forms 39, while the wheels 65 are simultaneously rotated/pivoted downwardly into engagement with the forms 39.

Instead of providing the conveyor belts 58, 64 as illustrated in FIGS. 9 through 11, lower diverter wheel mechanisms may be provided associated with the upper diverter wheels 59, 65. As seen in FIG. 14, a first set of lower diverter wheels shown generally by reference numeral 88 may be associated with the upper diverter wheels 59, and a second set of lower diverter wheels 89 associated with the upper diverter wheels 65. The assembly 88 includes two wheels 90 which are mounted for rotation about axes that are typically vertically substantially aligned with the pin 70, the wheels 90 engaging the wheels 59 when the wheels 59 are in their lower position. The wheels 91 engage the wheels 65 when they are pivoted/rotated downwardly, the wheels 91 being mounted for rotation by pins which are substantially vertically aligned with and parallel to the pins 71. Plate 92 is used to support forms 39 during movement in directions 12' and 12". A frame 98 may be provided for mounting the mechanisms 88, 89. A roller 93 may be provided along with belts 112 that engage grooves 97 in shaft 93 and grooves 115 in wheels 90 and 91 and mounted in frame 113, to drive forms 39 in the direction 12. The roller 93 may be driven by a pulley 95 thereon. The pulley 95 is driven by a belt 96 connected between the pulley 95 and the pulley 49 which is driven by an electric motor 24. The belt 99 may also be driven by the motor 50, which in turn powers the conveyor belts 21, 22 of the mechanism 14' (the interconnections thereof not being shown in FIG. 14).

A ball retainer 94 (see FIG. 15 in particular) is preferably also provided over the third through fifth balls 31 (in the direction 12) of each of the mecahnisms 26, 27 in FIG. 9, as shown schematically by line 94 in FIG. 9.

With particular reference to the electrical schematic on the right hand side of FIG. 8, in conventional operation of the embodiment of FIGS. 9 through 14 will now be described.

OPERATION OF FIG. 9 EMBODIMENT

As the leading edge of the first form 39 in the first job set passes under the infeed sensor 67 the system is initialized (i.e. the NS nip wheels 59 are raised and the FS nip wheels 65 are lowered. This is done by energizing motor 77. Also the solenoids 32 over balls (31) #1 and #2 on the NS [e.g. associated with mechanism 26 are energized while solenoids 32 over balls (31) #1 and #2 on the FS [e.g. associated with mechanism 27] are de-energized, thus dropping these balls onto belt 22). As the trailing edge of the last form in the first job set passes under the infeed sensor 67 the motor 77 reverses direction causing the FS wheels 65 to be lifted and simultaneously the NS wheels 59 to be lowered. Now as the leading edge of the first form in the second job set passes under the infeed sensor 67 the solenoids 32 over balls #1 and #2 on the FS are energized, lifting these two balls off belt 22, and simultaneously the solenoids on the NS are de-energized, dropping these two balls onto belt 21. The sequence is continued until the sensor 41 senses that the stacker 13 is full, at which time the controller 42 controls the motors 24 and 60 or 98 to stop conveying action until the stacker 13 is emptied.

It will thus be seen that according to the present invention an advantageous apparatus and method have been provided which ensure continuous (without interruption) offset stacking of business forms or other substantially planar elements, at least until the vertical stacker is filled with a plurality of different groups of forms. Thus the method and apparatus according to the present invention provide in a simple yet effective manner high speed job separation. Alternatively instead of the stacker 13 a powered stacker/conveyor belt may be provided which automatically conveys the forms out of alignment with the shingling conveyor 16 after, for example, two groups or stacks of offset forms are produced, thus providing completely continuous operation.

While the invention has been herein shown and described in what is presently conceived to be the most practical and preferred embodiment thereof it will be apparent to those of ordinary skill in the art that many modifications may be made thereof within the scope of the invention, which scope is to be accorded the broadest interpretation of the appended claims so as to encompass all equivalent structures and processes.

What is claimed is:

1. Apparatus for handling business forms to produce offset stacks of business forms, comprising:

a first set of powered bottom conveying structures for conveying business forms in a first generally horizontal direction;

a second set of powered bottom conveying structures for conveying business forms in the generally horizontal direction, and positioned with respect to the first direction so that there is a small angle between the first and second directions;

a first set of upper business forms engaging structures for selectively cooperating with the first set of bottom conveying structures and mounted above said first set of bottom conveying structures for selective movement into and out of operative association with said first set of bottom conveying structures;

a second set of upper business forms engaging structures for selectively cooperating with the second set of bottom conveying structures and mounted above said second set of bottom conveying structures for selective movement into and out of operative association with said second set of bottom conveying structures;

a powered mechanism for automatically moving said first set of engaging structures downwardly into operative association with said first set of bottom conveying structures while said second set of engaging structures is moved upwardly out of operative association with said second set of bottom conveying structures; and vice versa;

a continuous business forms detaching mechanism located upstream of said conveying structures in said first and second directions; and a stacker for individual business forms located downstream of said conveying structures in said first and second directions.

2. Apparatus as recited in claim 1 further comprising a guide assembly between said detaching mechanism and said conveying structures, and a shingling conveyor between said conveying structures and said stacker.

3. Apparatus as recited in claim 1 further comprising first and second side rails mounted adjacent said first and second bottom conveying structures for engaging side edges of business forms as they are conveyed in said first or second direction, said bottom conveying structures being disposed between said first and second side rails.

4. Apparatus as recited in claim 1 further comprising a plurality of sensors for sensing the positions of business forms as the forms move in said first or second directions.

5. Apparatus as recited in claim 4 further comprising control means for controlling said conveying structures and for controlling said powered mechanism in response to said sensors so as to provide continuous operation of said apparatus so that offset stacks of business forms are formed without interruption between stacks.

6. Apparatus as recited in claim 5 wherein said control means comprises means for energizing each of said solenoids of said first engaging structures in sequence while de-energizing the corresponding solenoids of said second engaging structures in sequence, or vice versa.

7. Apparatus for handling substantially planar elements to produce offset stacks of substantially planar elements, comprising:

a first set of powered bottom conveying structures for conveying substantially planar elements in a first generally horizontal direction;

a second set of powered bottom conveying structures for conveying substantially planar elements in a second generally horizontal direction, and positioned with respect to the first direction so that there is a small angle between the first and second directions;

a first set of upper planar element engaging structures for selectively cooperating with the first set of bottom conveying structures and mounted above said first set of bottom conveying structures for selective movement into and out of operative association with said first set of bottom conveying structures;

a second set of upper planar element engaging structures for selectively cooperating with the second set of bottom conveying structures and mounted above said second set of bottom conveying structures for selective movement into and out of operative association with said second set of bottom conveying structures; and a powered mechanism for automatically moving said first set of engaging structures downwardly into operative association with said first set of bottom conveying structures while said second set of engaging structures is moved upwardly out of operative association with said second set of bottom conveying structures, and vice versa.

8. Apparatus as recited in claim 7 wherein said first and second sets of bottom conveying structures comprise first and second angled endless conveyor belts.

9. Apparatus as recited in claim 7 wherein said first and second sets of upper engaging structures comprise first and second linear frames, each mounting a plurality of rounded surface magnetic material elements; and wherein said powered mechanism comprises a solenoid in association with each of said rounded surface magnetic material elements which when energized lifts the rounded surface magnetic material element associated therewith out of operative engagement with a planar element on a bottom conveying structure, and when deenergized allows the rounded surface magnetic material element associated therewith to fall into operative engagement with a planar element on a bottom conveying structure.

10. Apparatus as recited in claim 9 wherein said rounded surface magnetic material elements comprise steel balls.

11. Apparatus as recited in claim 10 wherein each solenoid includes a ball engaging element that is contoured to substantially conform to the rounded surface of a ball.

12. Apparatus as recited in claim 9 further comprising a plurality of sensors for sensing the positions of substantially planar elements as the elements move in said first or second directions.

13. Apparatus as recited in claim 12 further comprising control means for controlling said conveying structures and for controlling said powered mechanism in response to said sensors so as to provide continuous operation of said apparatus so that offset stacks of substantially planar elements are formed without interruption between stacks.

14. Apparatus as recited in claim 13 wherein said control means comprises means for energizing each of said solenoids of said first engaging structures in sequence while de-energizing the corresponding solenoids of said second engaging structures in sequence, or vice versa.

15. Apparatus as recited in claim 9 wherein said first and second sets of bottom conveying structures comprise first and second angled endless conveyor belts.

16. Apparatus as recited in claim 15 wherein said bottom conveying structures make an angle of roughly about 4° with respect to each other.

17. Apparatus as recited in claim 7 further comprising first and second side rails mounted adjacent said first and second bottom conveying structures for engaging side edges of substantially planar elements as they are conveyed in said first or second direction, said bottom conveying structures being disposed between said first and second side rails.

18. Apparatus as recited in claim 17 further comprising powered means for moving said first and second rails toward or away from each other to accommodate substantially planar elements of different widths.

19. Apparatus as recited in claim 17 wherein each of said side rails has a depression formed therein for engaging an edge of a substantially planar element.

20. Apparatus as recited in claim 7 wherein said first and second sets of upper engaging structures each comprise one or more upper diverter wheels.

21. Apparatus as recited in claim 20 wherein said upper diverter wheels are in pairs and mounted for rotation about a substantially horizontal shaft, and wherein said powered mechanism comprises a motor for pivoting said shaft about an axis parallel to said shaft.

22. Apparatus as recited in claim 21 wherein said pairs of diverter wheels are connected so that said motor rotates said shaft to pivot said first set of upper engaging structures in a first direction while said second set of upper engaging structures is simultaneously pivoted in a second direction opposite said first direction.

23. Apparatus as recited in claim 20 further comprising first and second endless angled or straight conveyor belts downstream of said diverter wheels in said first and second directions, and rounded surface substantially planar element engaging structures mounted above said first and second conveyor belts.

24. Apparatus as recited in claim 20 wherein each of said first and second bottom conveying structures comprise one or more lower diverter wheels.

25. Apparatus as recited in claim 7 further comprising a plurality of sensors for sensing the positions of substantially planar elements as the elements move in said first or second directions.

26. Apparatus as recited in claim 25 further comprising control means for controlling said conveying structures and for controlling said powered mechanism in response to said sensors so as to provide continuous operation of said apparatus so that offset stacks of substantially planar elements are formed without interruption between stacks.

27. Apparatus as recited in claim 26 wherein said control means comprises means for energizing each of said solenoids of said first engaging structures in sequence while de-energizing the corresponding solenoids of said second engaging structures in sequence, or vice versa.

28. Apparatus as recited in claim 7 wherein said bottom conveying structures make an angle of roughly about 4° with respect to each other.

* * * * *